US006584733B2

(12) United States Patent
Wade

(10) Patent No.: US 6,584,733 B2
(45) Date of Patent: Jul. 1, 2003

(54) INTERNAL CORNER ROOF GUTTERS

(76) Inventor: Rodney George Wade, 17 Wongawallen Drive, Upper Coomera, Queensland (AU), 4210

( * ) Notice: Subject to any disclaimer, the term of this patent is extended or adjusted under 35 U.S.C. 154(b) by 14 days.

(21) Appl. No.: 09/836,359

(22) Filed: Apr. 18, 2001

(65) Prior Publication Data

US 2002/0152691 A1 Oct. 24, 2002

(51) Int. Cl.[7] ..... E04D 13/00

(52) U.S. Cl. ..... 52/14; 52/12; 52/16

(58) Field of Search ..... 52/11, 12, 13, 52/14, 15, 16, 97, 746.11; 248/48.1

(56) References Cited

U.S. PATENT DOCUMENTS 4,615,153 A * 10/1986 Carey ..... 52/12
5,526,612 A * 6/1996 Wade ..... 52/12
6,263,618 B1 * 7/2001 Jones ..... 52/12

* cited by examiner

*Primary Examiner*—Carl D. Friedman
*Assistant Examiner*—Naoko Slack
(74) *Attorney, Agent, or Firm*—Millen, White, Zelano & Branigan, P.C.

(57) ABSTRACT

A method and apparatus for preventing the blockage of an internal corner roof gutter (31). An opening is formed at the intersection of the two gutters (12, 13) and a rainwater head (30) with attached downpipe is fitted under the opening. The rainwater head can be designed to include an arcuate section (32) which extends between the two faces of the gutter.

9 Claims, 1 Drawing Sheet

INTERNAL CORNER ROOF GUTTERS

BACKGROUND OF THE INVENTION

This invention relates to rainwater guttering systems for roofs of buildings, and is particularly concerned with a method and apparatus for preventing the blockage of internal corner roof gutters located at the bottom of valley gutters.

A roof valley is the region where two inclined roofs meet. This region has a substantially V-shaped cross-sectional configuration and generally slopes in one direction toward the edge of the building. A metal tray or gutter is located in the roof valley to collect water flowing from the roof cladding and to direct the water to a roof gutter. During downpours, very large volumes of water and debris can be collected from the roof and wash down into the roof gutter. The design of the roof gutter is such that the flow from the valley gutter is split in half, with one portion going with the flow in the roof gutter and the other portion being pushed against the flow. This can create blockage in the roof gutter if debris is present, and cause a back-up of water invariably leading to overflow and, in some instances, internal water damage to the building.

OBJECT OF THE INVENTION

It is therefore an object of this invention to provide a satisfactory solution to the aforementioned problem or to at least provide the public with a useful alternative.

SUMMARY OF THE INVENTION

According to one aspect of the present invention there is provided a method for preventing the blockage of an internal corner roof gutter to be located at the bottom of a valley gutter, which method comprises the steps of:

(i) Transversely cutting a rear wall and base of a roof gutter, in which an internal corner is to be formed;

(ii) bending the gutter at right angles at the cut so as to produce an opening in the base and rear wall thereof;

(iii) fixing the roof gutter to an internal corner of a building fascia or other support means; and (iv) fitting a rainwater head with attached downpipe to the internal fascia or other support means, so as to extend at least partly below the roof gutter opening.

The rainwater head comprises a second aspect of the invention.

According to this second aspect of the present invention there is provided a rain head for fitting beneath a roof gutter located at an internal corner of a building, said rain head having a substantially quadrangular or triangular cross-sectional configuration to enable it to be snugly located between the relatively perpendicular walls defining the internal fascia or other support means for the roof gutter, the said rainhead including a compartment with an upwardly facing inlet and a downwardly facing outlet, said inlet incorporating a primary screen which is supported in such a manner as, in use, to deflect debris away from the compartment whilst permitting water to flow through it and into the compartment for discharge through the outlet.

DESCRIPTION OF THE INVENTION

The compartment can optionally include a secondary screen located between the primary screen and the outlet, to prevent the ingress of vectors such as mosquitoes to the outlet. Such a secondary screen is mandatory to meet government requirements if used in conjunction with the catchment and storage of rain water.

Preferably, the internal corner rain head will include flanges projecting upwardly from two adjacent sides to enable connection to the fascia or other support means by screws, nails or like fixing arrangements. Such flanges also act as "a splash back" to prevent the fascia from water damage.

The primary screen is typically angled so that the majority of rainwater and debris hits the screen as it falls through the gutter at between about 45° and 60°. This angle is skewed towards 45° for light rainfalls and towards 60° for high rainfalls by notching the upper edge of the primary screen upwards or downwards while maintaining the bottom edge of the screen in a fixed location. The screen can be manufactured from a range of non-corrosive materials such as plastics material, metal, composites, or a combination thereof. Powder coated galvanised iron stranded screens are particularly suitable as they enable the maximisation of the open spaces in the screening surface while simultaneously breaking any water capillarity in the openings. Preferred sizes for the openings in the primary screen are between 4×4 mm and 9×9 mm, most preferably about 6×6 mm.

The secondary screen when present can be manufactured from a similar range of materials to the primary screen. Preferably, however, it is manufactured from welded or wire woven stainless steel, zincalum, galvanised steel, brass, copper or fibreglass. The mesh size can typically be 0.9×0.9 mm and can include an appropriate support framework to enable retention of shape and ease of placement. A particularly preferred framework comprises a rectangle of plastics material in which the screen is embedded during the production thereof. Finger extensions are provided on opposing edges of the framework to enable the secondary screen to be placed in, and removed from, a recess which snugly holds the secondary screen when it is press-fitted therein.

In a further modification, the internal corner rain head can be designed to include a projection formed on its unattached peripheral side which which extends upwardly to the same height as the outer face of the roof gutter, so as to, in effect, extend across the corner of the roof gutter and thereby provide an attractive finish to the product.

The internal corner rain head permits the unimpeded flow of water and debris from the valley tray directly through the opening in the roof gutter and to the rain head, thereby obviating any blockage in the roof gutter and hence avoiding overflow and potential water damage to the building.

DESCRIPTION OF PREFERRED EMBODIMENT

Figure 1:
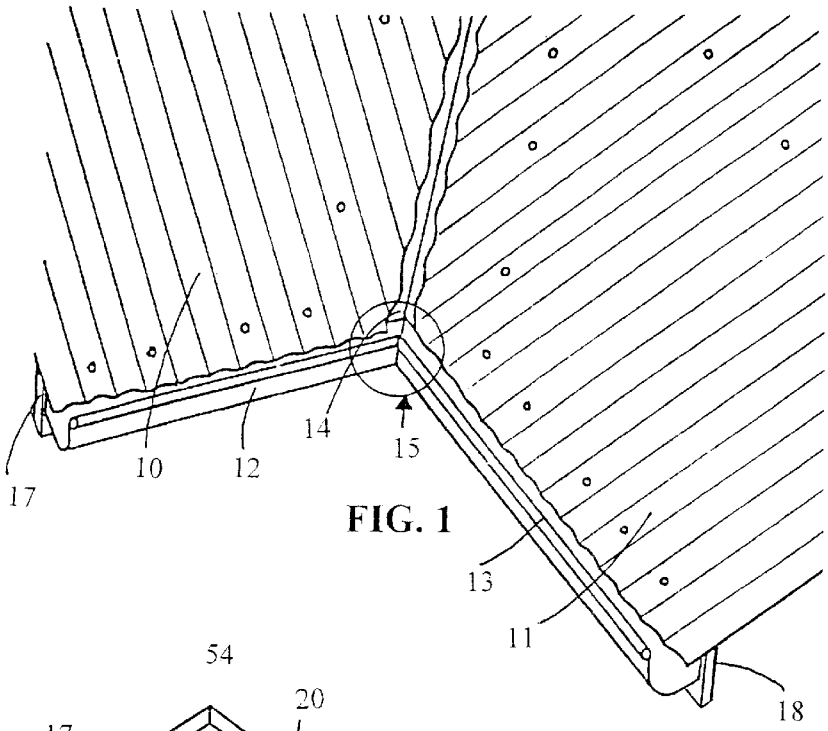
FIG. 1 is a top perspective view of a roof incorporating a typical valley gutter and internal corner gutter.

A preferred embodiment of the invention will now be described with reference to the accompanying drawings, in all of which like reference numerals refer to like parts.

Referring firstly to FIG. 1, a pitched roof is depicted comprising roof sections 10 and 11 which slope towards each other and towards their respective roof gutters 12, 13. The roof sections 10, 11 are separated by a valley gutter 14. In this arrangement, blockage and overflow typically occurs in the circled region 15.

Figure 2:
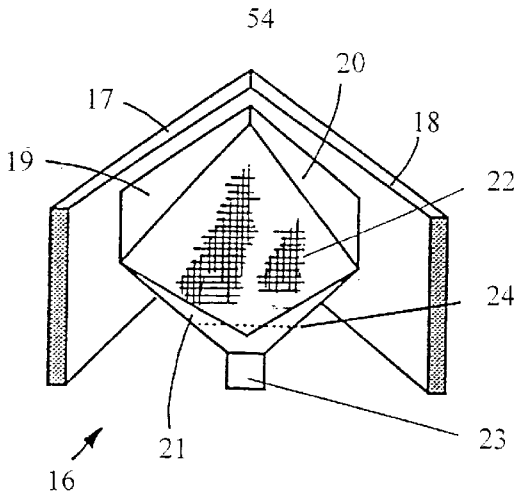
FIG. 2 is a cut-away perspective view of an internal corner rain head according to one aspect of the present invention.

FIG. 2 shows an internal corner rain head 16 which is adapted for fitting beneath the intersections of the two gutters 12, 13 depicted in FIG. 1. Firstly, an opening is made in the bottom wall of the intersecting gutters to enable water flowing down the valley gutter 14 to pass straight through the roof gutters. This opening can be reinforced by gussets, brackets or other known means. The internal corner rain head 16 is then fitted to the intersecting fascia plates 17, 18 by screws inserted through flanges 19, 20, directly below the opening in the gutters which has been created.

The internal corner rain head comprises a compartment 21 having an upwardly facing and inclined opening which is covered by a primary screen 22 and an outlet 23 for connecting to a rainwater downpipe of the building. A horizontal secondary screen is located within the compartment between the primary screen 22 and the outlet 23. The location of the secondary screen is indicated by the dotted line 24.

The primary screen has a planar configuration with square apertures measuring 6×6 mm.

The secondary screen is a planar 955 micro mesh designed to meet statutory requirements for vector exclusion.

Figure 3:
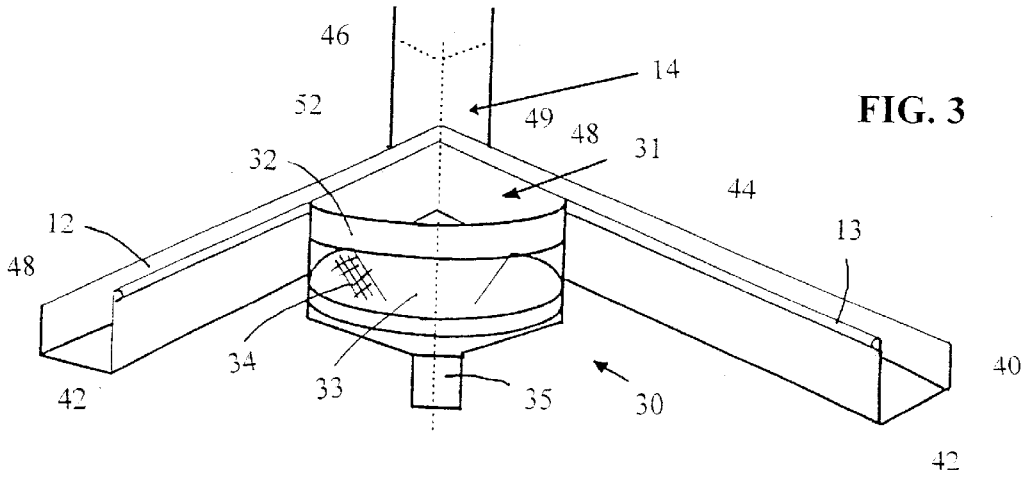
FIG. 3 is a cut-away perspective view of an internal corner rain head juxtaposed with respect to a roof gutter according to another aspect of the present invention.

An alternative embodiment of the internal corner rain head is depicted in FIG. 3. This rain head 30 differs from the preceding embodiment in that it is designed to cover over the corner section 31 of the intersecting roof gutters 12, 13. To this end, the rain head includes a projecting, segmental section 32 which extends in an arcuate fashion between the roof gutters 12, 13. An opening 33 in the wall of the rain head permits ejection of debris being washed down from the valley gutter 14 while the water flows on down through an inclined primary screen 34 to an outlet 35.

Although the FIG. 3 embodiment shows the screen sloping forward, it is also possible for the screen to slope backward to the wall of the building.

As is seen in FIGS. 1–3, a method for preventing the blockage of a roof gutter configured to have an internal corner to be located at the bottom of a valley gutter 14, comprises four steps:

(i) transversely cutting a rear wall 40 and base 42 of a roof gutter 44, in which an internal corner 46 is to be formed;

(ii) bending the gutter 44 at right angles at the cuts 48 and 49 through the rear wall 40 and base 42 so as to produce an opening 52 in the base 42 and rear wall 40 thereof;

(iii) fixing the roof gutter 44 to an internal corner 54 (see FIG. 2) of the building fascia 17 and 18 or other support means; and (iv) fitting a rainwater head 21 (FIG. 2) or 30 (FIG. 3) with attached downpipe 23 or 35 to the internal fascia 17 and 18 or other support means, so as to extend at least partly below the roof gutter opening 52.

The invention described above avoids any blockage or overflow in the region 15 of internal intersecting gutters 12, 13 at the foot of a valley gutter 14, and therefore provides a useful, commercial product.

Whilst the above has been given by way of illustrative example of the invention, many modifications and variation may be made thereto by persons skilled in the art without departing from the broad scope and ambit of the invention as herein set forth.

I claim:

1. A method for preventing the blockage of an internal corner roof gutter to be located at the bottom of a valley gutter, which method comprises the steps of:

(i) transversely cutting a rear wall and base of a roof gutter, in which an internal corner is to be formed;

(ii) bending the gutter at right angles at the cut so as to produce an opening in the base and rear wall thereof;

(iii) fixing the roof gutter to an internal corner of a building fascia or other support means; and (iv) fitting a rainwater head with attached downpipe to the internal fascia or other support means, so as to extend at least partly below the roof gutter opening.

2. A method for preventing the blockage of an internal corner roof gutter as claimed in claim 1, wherein the rain head comprises a substantially quadrangular of triangular cross-sectional configuration to enable it to be snugly located between the relatively perpendicular walls defining the internal fascia or other support means for the roof gutter, the said rainhead including a compartment with an upwardly facing inlet and a downwardly facing outlet, said inlet incorporating a primary screen which is supported in such a manner as, in use, to deflect debris away from the compartment whilst permitting water to flow through it and into the compartment for discharge through the outlet.

3. A method for preventing the blockage of an internal corner roof gutter as claimed in claim 2, wherein the rain head includes a secondary screen located between the primary screen and the outlet, to prevent the ingress of vectors such as mosquitoes to the outlet.

4. A method for preventing the blockage of an internal corner roof gutter as claimed in claim 3, wherein the size of the openings in the secondary screen is approximately 0.9×0.9 mm.

5. A method for preventing the blockage of an internal corner roof gutter as claimed in claim 2, wherein the rain head includes flanges projecting upwardly from two adjacent sides to enable connection to the fascia or other support means by screws, nails or equivalent fixing means.

6. A method for preventing the blockage of an internal corner roof gutter as claimed in claim 2, wherein the primary screen is angled so that the majority of rainwater and debris hits the screen as it falls through the gutter at an angle of between 45° and 60° with respect to the vertical.

7. A method for preventing the blockage of an internal corner roof gutter as claimed in claim 2, wherein the size of the openings in the primary screen is between 4×4 mm and 9×9 mm.

8. A method of for preventing the blockage of an internal corner roof gutter as claimed in claim 1, wherein the rain head includes a projection formed on its outwardly facing peripheral side which extends upwardly to the same height as the roof gutter so as to, in effect, extend across the corner of the roof gutter.

9. An internal corner rain head for use in the method defined in claim 1.

* * * * *